US005636923A

United States Patent [19]

Nejat-Bina

[11] Patent Number: 5,636,923

[45] Date of Patent: Jun. 10, 1997

[54] ELECTRIC SPIRAL BLADE RECYCLE FOOD MIXER

[76] Inventor: Iradj E. Nejat-Bina, 320 North Lapeer Dr., Apt. 201, Beverly Hills, Calif. 90211

[21] Appl. No.: 648,729

[22] Filed: May 16, 1996

[51] Int. Cl.[6] ..... B01F 7/24

[52] U.S. Cl. ..... 366/205; 366/314; 241/74; 241/82.3

[58] Field of Search ..... 366/205, 264, 366/266, 314, 318; 99/348, 510; 241/74, 82.1, 82.3, 199.11, 199.12, 260.1, 282.1, 282.2, 292.1

[56] References Cited

U.S. PATENT DOCUMENTS

| | | | |
|---|---|---|---|
| 33,973 | 12/1861 | Goewey | 366/266 |
| 1,951,684 | 3/1934 | Wells | 241/74 |
| 2,282,623 | 5/1942 | Torrence | 366/266 X |
| 2,785,547 | 3/1957 | Barros | 241/199.11 X |
| 3,188,942 | 6/1965 | Wandel | 241/74 X |
| 3,612,125 | 10/1971 | Krauth | 366/205 X |

*Primary Examiner*—Charles E. Cooley

[57] ABSTRACT

An electric recycle mixer including a blade cylinder with a top edge, a bottom edge and an outer wall. The bottom edge has a keyhole coupled to a connector member. The connector member has a blade drive with a first end and a second end. The first end of the blade drive is positioned within the keyhole. The connector member has a pair of fastener tabs on opposite sides. A pair of helical mixing blades extend from the top edge to the bottom edge of the blade cylinder, and are interconnected to the outer wall. A perforated cylinder is positioned over the blade cylinder, and has an intermediate portion with a plurality of holes. A lid threadably engages a neck portion of the perforated cylinder and retains the perforated cylinder in a fixed position. A generally cylindrical housing has the blade cylinder and the perforated cylinder therein, while coupling with the connector. The lid is snap-fastened to a top end of the housing. Lastly, a mixer motor is coupled to the connector and the second end of the blade drive.

9 Claims, 4 Drawing Sheets

FIG. 5
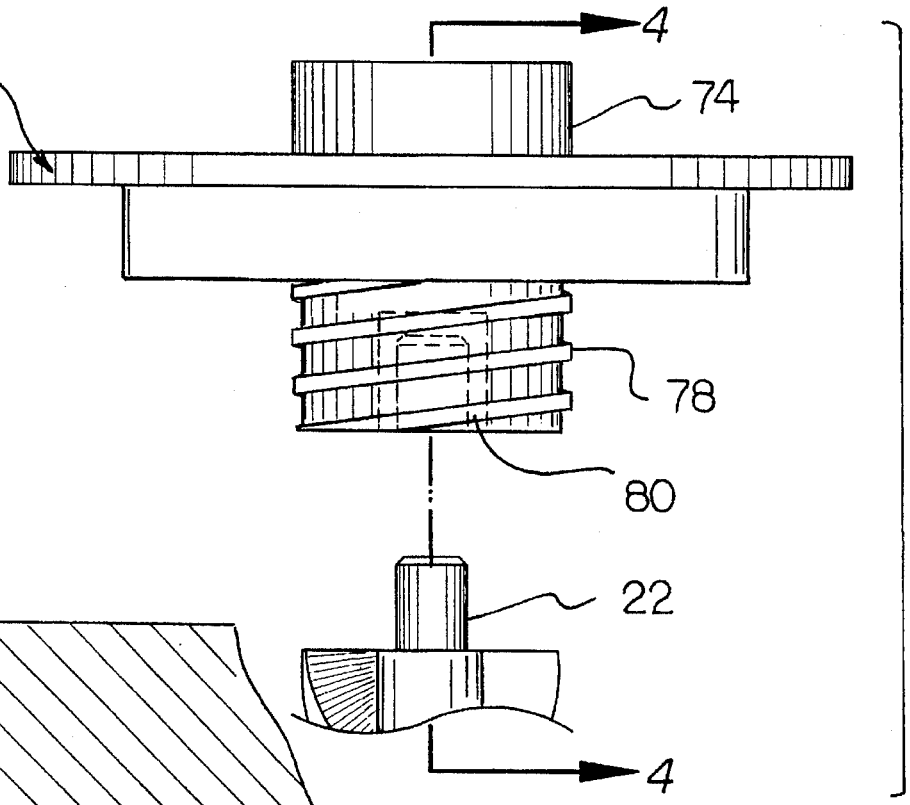
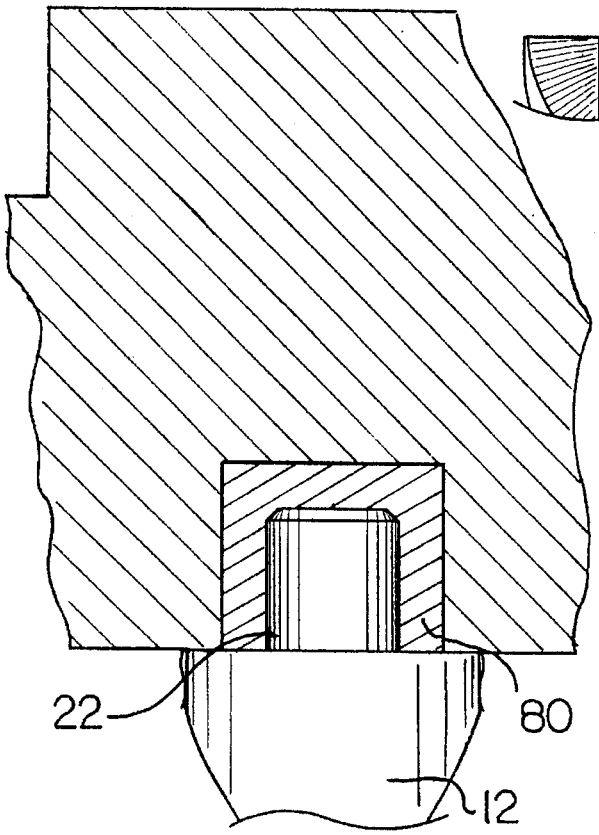
FIG. 4
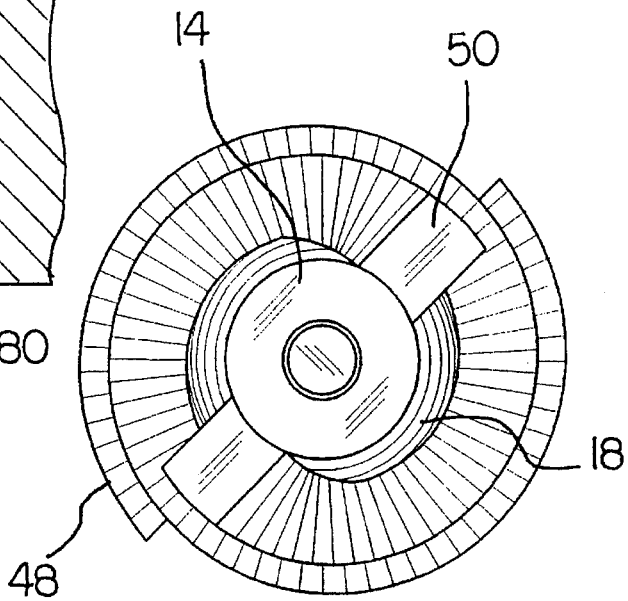
FIG. 6

ELECTRIC SPIRAL BLADE RECYCLE FOOD MIXER

BACKGROUND OF THE INVENTION

1. Field of the Invention

The present invention relates to an electric recycle mixer and more particularly pertains to providing a blender device that has a helical mixing blade positioned within a perforated cylinder, and both are contained within a housing, and further capable of effecting a recycling action during a mixing operation.

2. Description of the Prior Art

The use of a mixer is known in the prior art. More specifically, mixers heretofore devised and utilized for the purpose of blending foods or beverages are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,323,691 to Reese and Hasson discloses a frozen drink mixer. U.S. Pat. No. Des. 306,680 to Madl discloses a food processor attachment for a blender. U.S. Pat. No. 4,738,540 to Banks discloses a mixer/blender. U.S. Pat. No. 4,559,897 to Urrea, Doris and Newman discloses a hydrophilic lens tinting and coloring apparatus. U.S. Pat. No. 4,334,724 to Rogers, Sr. discloses a cabinet for a kitchen blender, mixer, grinder, et al. Lastly, U.S. Pat. No. Des. 260,250 to Kahlcke discloses an electric food blender.

While these devices fulfill their respective, particular objectives and requirements, the aforementioned patents do not describe an electric recycle mixer that allows the substance placed into the mixer to be blended with a recycling process, by pulling the substance up through and around the blade cylinder, then pushing the substance through the holes of the perforated cylinder, whereby, the substance again moves downwards to be pulled backup by the blade cylinder, to be passed through the holes of the perforated cylinder once again.

In this respect, the electric recycle mixer according to the present invention substantially departs from the conventional concepts and designs of the prior art, and in doing so provides an apparatus primarily developed for the purpose of providing a blender device that has a helical mixing blade positioned within a perforated cylinder, and both are contained within a housing, and further capable of effecting a recycling action during a mixing operation.

Therefore, it can be appreciated that there exists a continuing need for a new and improved electric recycle mixer which can be used for providing a blender device that has a helical mixing blade positioned within a perforated cylinder, and both are contained within a housing, and further capable of effecting a recycling action during a mixing operation. In this regard, the present invention substantially fulfills this need.

SUMMARY OF THE INVENTION

In view of the foregoing disadvantages inherent in the known types of mixers now present in the prior art, the present invention provides an improved electric recycle mixer. As such, the general purpose of the present invention, which will be described subsequently in greater detail, is to provide a new and improved electric recycle mixer and method which has all the advantages of the prior art and none of the disadvantages.

To attain this, the present invention essentially comprises a generally tower-shaped blade cylinder. The blade cylinder has a top edge and a bottom edge with an outer wall therebetween. The top edge has a cylindrical tip projecting therefrom. The bottom edge has a keyhole therethrough. The bottom edge of the blade cylinder is lockingly coupled to a connector member. The connector member has a generally cylindrical blade drive with a first end and a second end. The first end projects upwardly from one side of the connector, and the second end projects downwardly from another side of the connector. The first end of the blade drive, is positioned within the keyhole of the blade cylinder, and fixedly held in position by a catch pin of the keyhole. The connector member has a pair of fastener tabs that project from opposite sides thereof. A pair of helical mixing blades are interconnected to the outer wall of the blade cylinder. Each blade has a blunt edge. Each blade wraps around the blade cylinder along a symmetrical path. Each blade has an upper end adjacent the top edge of the blade cylinder. Each blade has a lower end adjacent the bottom edge of the blade cylinder. A perforated cylinder is positionable over the blade cylinder, when the blade cylinder is coupled to the connector. The perforated cylinder has an internal threaded neck portion, a bowl-like bottom portion and an intermediate portion. The intermediate portion has a plurality of holes dispersed thereon. A lid threadably engages the neck portion of the perforated cylinder. The lid is capable of retaining the perforated cylinder in a fixed position while the perforated cylinder is positioned over the blade cylinder. When the perforated cylinder and the lid are coupled, and the perforated cylinder is positioned over the blade cylinder, the tip of the blade cylinder is positioned within the lid. A generally cylindrical housing is coupled with the connector prior to the connector being coupled with the blade cylinder. The housing can have the blade cylinder and perforated cylinder positioned therein, with the lid snap-fastened to a top end. Lastly, a mixer motor is capable of supporting the housing, with the blade cylinder and perforated cylinder therein. The mixer motor has an outer wall and a rotating mechanism. The outer wall has a pair of L-shaped slots for lockingly engaging the fastener tabs of the connector. The rotating mechanism is capable of lockingly engaging the second end of the blade drive of the connector. The mixing motor has a switch for turning the motor on and off. Whereby, when the motor is turned on, the rotating mechanism is capable of causing the blade cylinder to rotate clockwise within the perforated cylinder and the lid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electric recycle mixer which has all of the advantages of the prior art mixers and none of the disadvantages.

It is another object of the present invention to provide a new and improved electric recycle mixer which may be easily and efficiently manufactured and marketed.

It is further object of the present invention to provide a new and improved electric recycle mixer which is of durable and reliable constructions.

An even further object of the present invention is to provide a new and improved electric recycle mixer which is susceptible of a low cost of manufacture with regard to both materials and labor, and which accordingly is then susceptible of low prices of sale to the consuming public, thereby making such electric recycle mixer economically available to the buying public.

Still yet another object of the present invention is to provide a new and improved electric recycle mixer which provides in the apparatuses and methods of the prior art some of the advantages thereof, while simultaneously overcoming some of the disadvantages normally associated therewith.

Even still another object of the present invention is to provide a electric recycle mixer for providing a blender device that has a helical mixing blade positioned within a perforated cylinder, and both are contained within a housing, and further capable of effecting a recycling action during a mixing operation.

Lastly, it is an object of the present invention to provide a new and improved electric recycle mixer including a blade cylinder that has a top edge, a bottom edge and an outer wall. The bottom edge has a keyhole being lockingly coupled to a connector member. The connector member has a generally cylindrical blade drive with a first end and a second end. The first end of the locking is positioned within the keyhole of the blade cylinder. The connector member has a pair of fastener tabs on opposite sides thereof. A pair of helical mixing blades extend from the top edge to the bottom edge of the blade cylinder, and are interconnected to the outer wall of the blade cylinder. A perforated cylinder is positioned over the blade cylinder, and has an intermediate portion with a plurality of holes dispersed thereon. A lid threadably engages a neck portion of the perforated cylinder and retains the perforated cylinder in a fixed position. A generally cylindrical housing has the blade cylinder and the perforated cylinder therein, while coupling with the connector. The lid is snap-fastened to a top end of the housing. Lastly, a mixer motor is coupled to the connector and the second end of the blade drive. The mixer supports the housing with the blade cylinder and perforated cylinder therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a top cut-away view of the blade cylinder, perforated cylinder and lid in an operable configuration.

FIG. 5 is a cross sectional view of the coupling of the lid and cylinder taken along line 5—5 of FIG. 4.

FIG. 6 is a top plan view of the blade cylinder of FIG. 1 of the present invention.

The same reference numerals refer to the same parts through the various Figures.

DESCRIPTION OF THE PREFERRED EMBODIMENT

Figure 1:
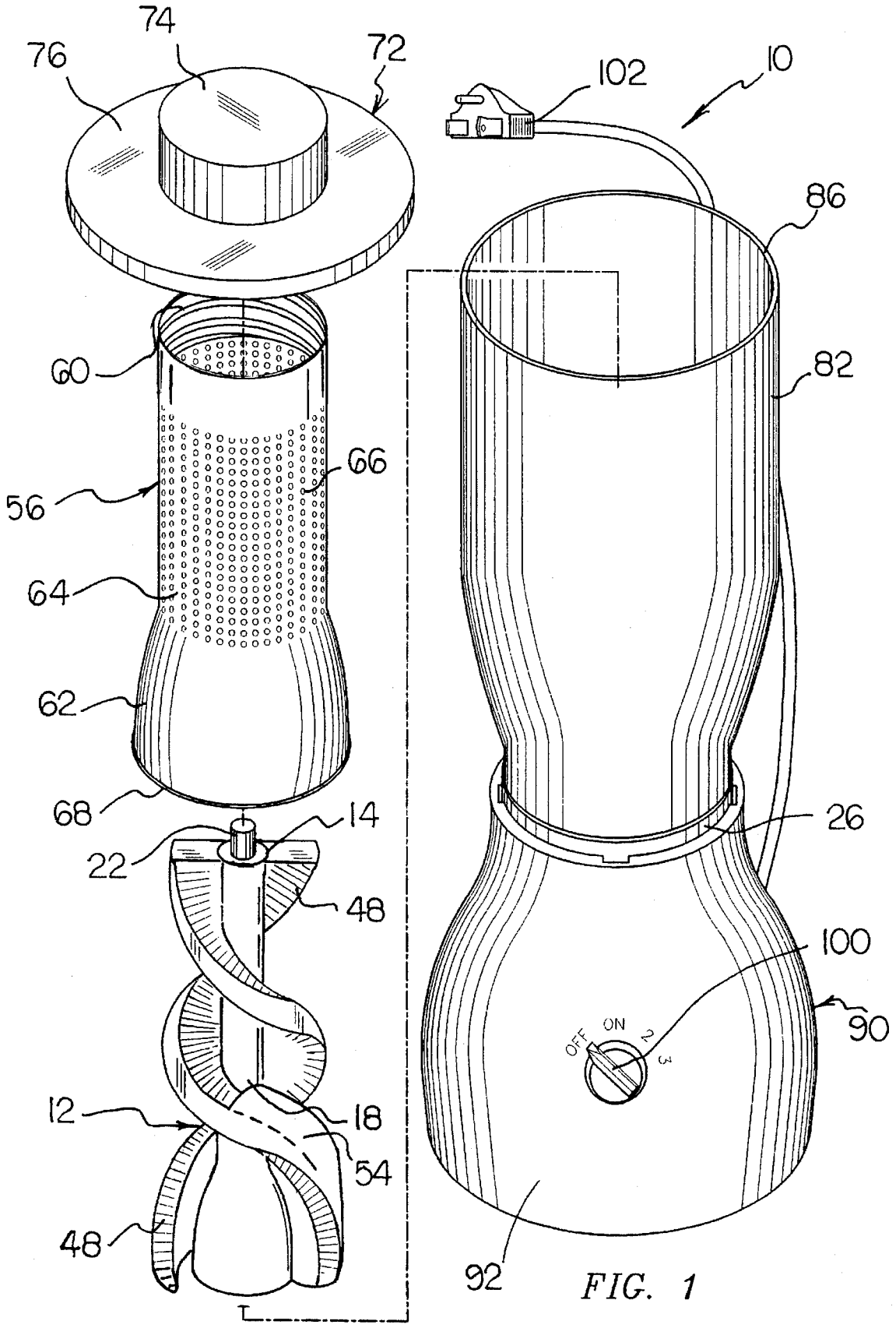
FIG. 1 is an exploded perspective view of the preferred embodiment of the electric recycle mixer constructed in accordance with the principles of the present invention.

With reference now to the drawings, and in particular to FIG. 1 thereof, the preferred embodiment of the new and improved electric recycle mixer embodying the principles and concepts of the present invention and generally designated by the reference numeral 10 will be described.

The present invention, the electric recycle mixer 10 is comprised of a plurality of components. Such components in their broadest context include a blade cylinder, a perforated cylinder, a housing and a lid. Such components are individually configured and correlated with respect to each other so as to attain the desired objective.

Figure 7:
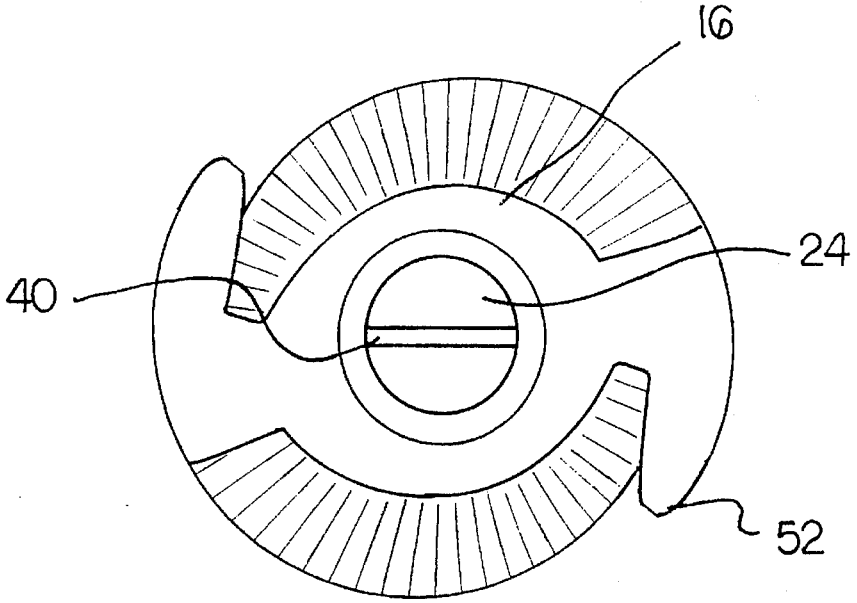
FIG. 7 is a bottom plan view of the blade cylinder of FIG. 1.
Figure 8:
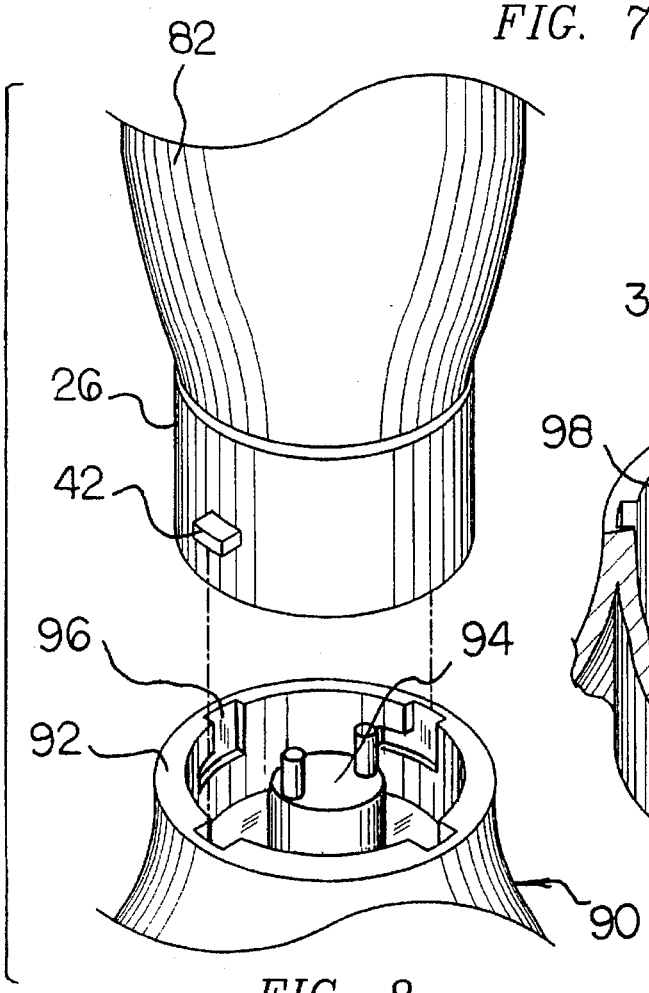
FIG. 8 is an exploded view of the connector and the mixer motor.
Figure 9:
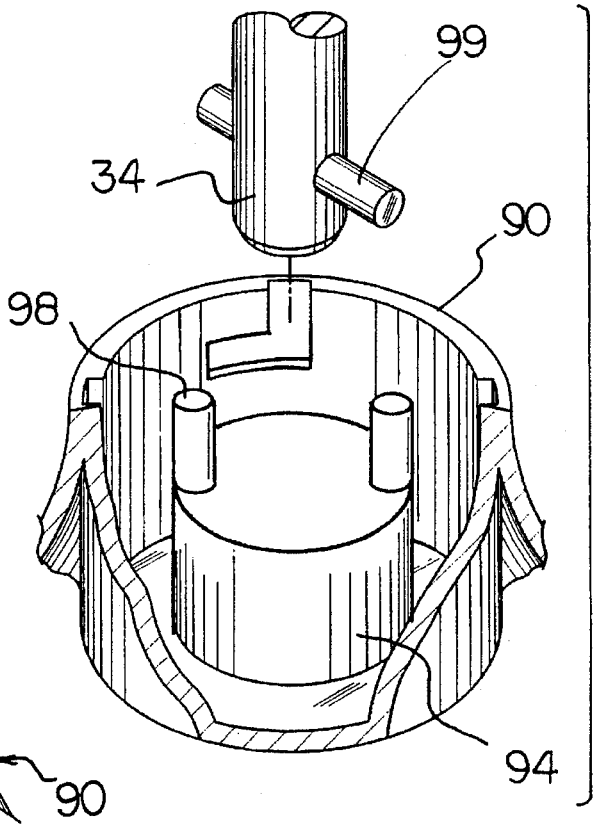
FIG. 9 is a cut-away view of the second blade drive with respect to the rotating mechanism of the mixer motor.

Specifically, the present invention includes a generally tower-shaped blade cylinder 12. The blade cylinder has a top edge 14 and a bottom edge 16 with an outer wall 18 therebetween. The blade cylinder of FIG. 1 is made of stainless steel or a rigid plastic. The blade cylinder has a diameter that increases near the bottom edge. The top edge has a cylindrical tip 22 projecting therefrom and interconnected. The bottom edge, as seen in FIG. 7, has a keyhole 24 therethrough. The bottom edge of the blade cylinder is lockingly coupled to a connector member 26.

Figure 2:
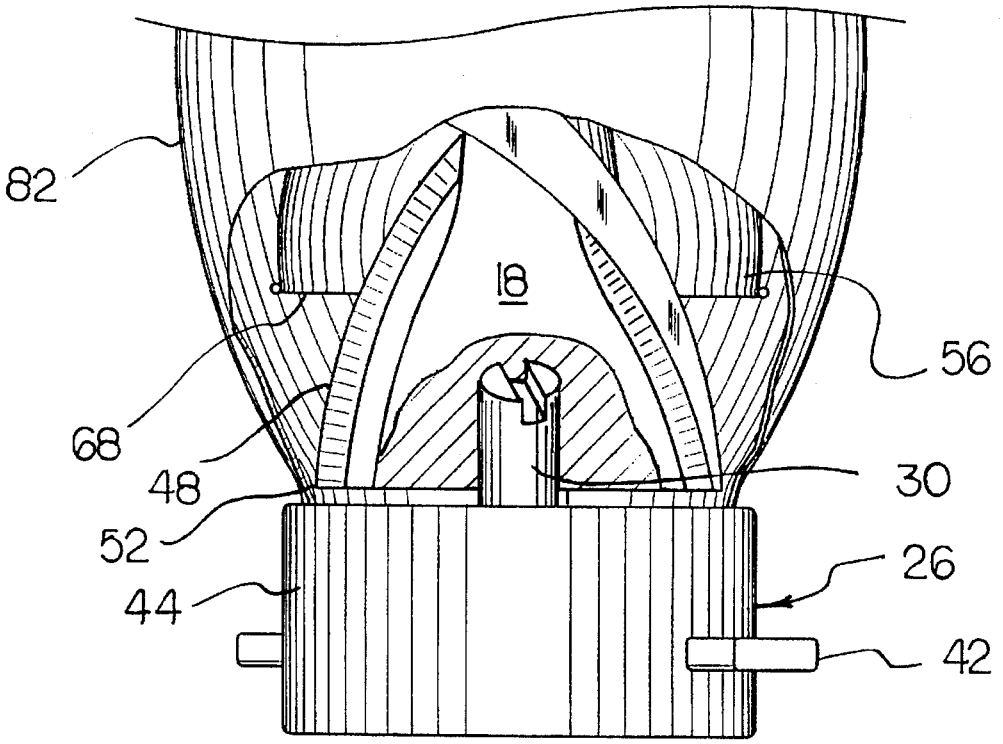
FIG. 2 is a cut-away cross sectional view of the operable components of the present invention.
Figure 3:
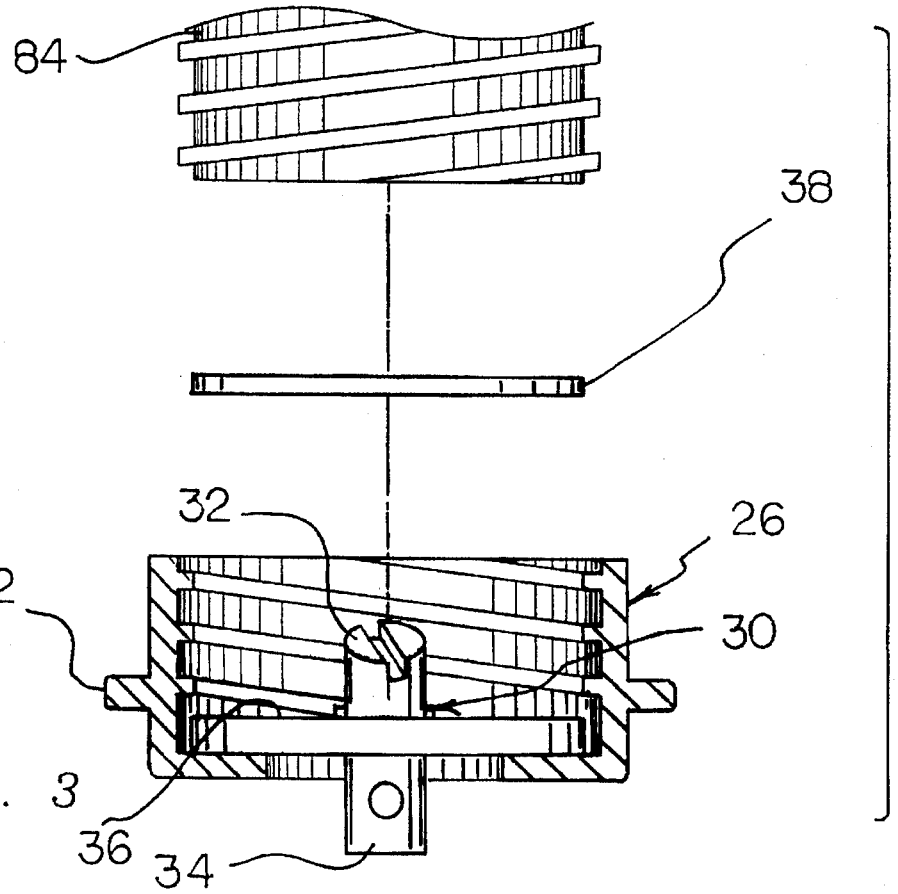
FIG. 3 is an exploded view of the housing in relationship to the connector, with the connector shown cross sectionally.

As best illustrated in FIGS. 2 and 3, the connector member 26 has a generally cylindrical blade drive 30 with a first end 32 and a second end 34. The connector has a support disc 36 that is fixedly attached within. The disc allows the blade drive to rotate within the center thereof. The connector member is formed of stainless steel or a rigid plastic. The first end of the blade drive projects upwardly from one side of the disc of the connector. The second end of the blade drive projects downwardly from another side of the disc of the connector.

A rubber washer 38 is positioned flush the disc and adjacent the first end of the blade drive. The rubber washer prevents substances from passing beyond the disc of the connector. The first end of the blade drive is slotted to capture a catch pin 40 of the keyhole. The first end is locked in position, within the keyhole 24 of the blade cylinder, by the catch pin of FIG. 7. The first end lockingly engages the blade cylinder. The connector member has a pair of fastener tabs 42 that project from opposite sides of the connector. The fastener tabs are interconnected to the side wall 44 of the connector.

Also, a pair of helical mixing blades 48 are interconnected to the outer wall 18 of the blade cylinder 12. The blades are formed of the same material used to make the blade cylinder. Each blade is interconnected to the blade cylinder, as seen in FIG. 2 and has a blunt edge. Each blade wraps around the blade cylinder along a symmetrical path. Each blade has an upper end 50 adjacent the top edge 14 of the blade cylinder. Each blade has a lower end 52 adjacent the bottom edge 16 of the blade cylinder. The blade increases in diameter, as it traverses the blade cylinder from top to bottom, with the smallest diameter at the upper end. The lower end of each blade has a lip extension 54, as shown in FIG. 1. The lip extension increases the force of rotation that is applied against the substances placed into the mixer during operation.

Additionally, a perforated cylinder 56 is positionable over the blade cylinder when the blade cylinder is coupled to the connector 26. The perforated cylinder, when placed over the blade cylinder creates a circulation cavity. The perforated cylinder is stainless steel and has smooth outer and inner surface. The perforated cylinder, as seen in FIG. 1, has an internal threaded neck portion 60, a bowl-like bottom portion 62 and an intermediate portion 64. The intermediate portion has a plurality of holes 66 dispersed thereon. The bowl-like bottom portion allows the blades to engage large amounts of the substance placed into the mixer. Also, the bowl-like portion, as seen in FIG. 2, has a lower rim 68 spaced from the lower end of the blade, when the perforated cylinder covers the blade cylinder.

FIG. 5 shows a lid 72 that is capable of engaging the neck portion 60 of the perforated cylinder 56. The lid has a plastic center member 74 and a rubber outer portion 76. The center member of the lid has a threaded lower extent 78, as shown in FIG. 5. The center member of the lid retains the perforated cylinder 56 in a fixed position when the two are coupled. Coupling of the lid and the perforated cylinder occurs when the threaded neck of the perforated cylinder is engaged by the threaded lower extent of the lid, as seen in FIG. 4. The fixed position must be maintained while the perforated cylinder is positioned over the blade cylinder 12 and the perforated cylinder and lid are coupled. When the perforated cylinder is positioned over the blade cylinder the tip 22 of the blade cylinder is positioned within the lid, as seen in FIG. 4. The center member of the lid has bushings 80, that engage the tip, when the blade cylinder is rotated. The bushings allow the tip to rotate within the lid during operation of the mixer.

Included is a generally cylindrical housing 82. The housing couples with the connector 26 prior to the connector being coupled with the blade cylinder 12. The housing has a threaded end 84 and a top end 86. The housing of FIG. 1 is made of stainless steel, plastic or glass. In operation, the threaded end of the housing engages the connector. Then the blade cylinder is locked to the connector with the first end of the blade drive. Lastly, the housing has the blade cylinder and perforated cylinder positioned within. The outer portion 76 of the lid snap fastens to the top end 86 of the housing.

Finally, a mixer motor 90 supports the housing, with the blade cylinder and perforated cylinder therein, as shown in FIG. 1. The mixer motor has an outer wall 92 and a rotating mechanism 94. The outer wall is formed of plastic or stainless steel, and has a pair of L-shaped slots 96 for lockingly engaging the fastener tabs 42 of the connector 26. The rotating mechanism is a metal unit attached to the motor (not shown), and capable of rotating counter clockwise. The rotating mechanism has a pair of vertical rods 98 projecting upward. The vertical rods engage the horizontal rods 99 of the second end of the blade drive 34 of the connector when placed therein.

The mixer motor has a switch 100 for turning the motor on and off, when the plug 102 is connected. Whereby, when the motor is turned on the rotating mechanism causes the blade cylinder to rotate clockwise within the perforated cylinder and the lid. The rotation of the blade cylinder pulls substances, placed into the mixer, in an upward direction. When the substances begin to mix, they are pushed through the holes of the perforated cylinder. The substances, because of gravity, travel downward to be pulled back up by the blades again. This cycling process continues until the substances are thoroughly blended.

The present invention is an easy to use electric recycle mixer. The main component of this invention is the blade. The blade is a generally conical cylinder that has two blades traversing the left and right of the blade cylinder in a symmetrical form. Each blade has a lip extension that cause the turbulence of the substance in the mixer to be more violent that the standard mixer. Included with the operation of a blade is a perforated cylinder that has a plurality of holes along an intermediate portion thereof.

Also, the perforated cylinder is locked to the lid of the mixer while a tip portion of the blade cylinder rotates within the lid. The contents or substances are placed inside the mixer. When the mixer is turned on the motion of the spiral blade twist and forces the material to go upward along the blades between the blade cylinder and the perforated cylinder. As the substance is blended, it circulates through the holes and along side the wall of the housing. The motion of the blade cylinder and blade is a continuous motion as long as the electric motor is turned on. The blades connected to the blade cylinder are narrow at the bottom. The present invention has industrial use as well as consumer usage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved electric spiral blade recycle food mixer blade for mixing substances together throughly comprising in combination:

a generally tower-shaped blade cylinder having a top edge and a bottom edge with an outer wall therebetween, the top edge having a cylindrical tip projecting therefrom, the bottom edge having an keyhole therethrough, the bottom edge of the blade cylinder being lockingly coupled to a connector member;

the connector member having a generally cylindrical blade drive with a first end and a second end, the first end projecting upwardly from one side of the connector member and the second end projecting downwardly from another side of the connector member, the first end of the blade drive being positionable within the keyhole of the blade cylinder and fixedly held in position by engaging a catch pin of the keyhole, the connector member having a pair of fastener tabs projecting from opposite sides of the connector member;

a pair of helical mixing blades being interconnected to the outer wall of the blade cylinder, each blade having a blunt edge, each blade wrapping around the blade cylinder along a symmetrical path, each blade having an upper end adjacent the top edge of the blade cylinder, each blade having a lower end adjacent the bottom edge of the blade cylinder;

a perforated cylinder being positioned over the blade cylinder when the blade cylinder being coupled to the connector member, the perforated cylinder having an internal threaded neck portion, a bowl-like bottom portion and an intermediate portion, the intermediate portion having a plurality of holes dispersed thereon;

a lid threadably engaging the neck portion of the perforated cylinder, the lid retaining the perforated cylinder in a fixed position, when placed over the blade cylinder, and the perforated cylinder and lid being coupled, and the perforated cylinder being positioned over the blade cylinder with the tip of the blade cylinder being positioned within the lid;

a generally cylindrical housing being capable of coupling with the connector member prior to the connector member being coupled with the blade cylinder, the housing being capable of having the blade cylinder and perforated cylinder positionable therein with the lid snap fastened to a top end of the housing; and a mixer motor being capable of supporting the housing having the blade cylinder and perforated cylinder therein, the mixer motor having an outer wall and a rotating mechanism, the outer wall having a pair of L-shaped slots for lockingly engaging the fastener tabs of the connector member, the rotating mechanism being capable of lockingly engaging the second end of the blade drive of the connector member, the mixer motor having a switch for turning the motor on and off, and the motor being turned on for allowing the rotating mechanism to cause the blade cylinder to rotate clockwise within the perforated cylinder and the lid.

2. An electric spiral blade recycle food mixer comprising:

a blade cylinder having a top edge, a bottom edge and outer wall therebetween, the bottom edge having a key hole being lockingly coupled to a connector member;

the connector member having a generally cylindrical blade drive with a first end and a second end, the first end of the blade drive being positionable within the keyhole of the blade cylinder, the connector member having a pair of fastener tabs being on opposite sides thereof;

a pair of helical mixing blades extending from the top edge to the bottom edge of the blade cylinder, and being interconnected to the outer wall of the blade cylinder;

a perforated cylinder being positionable over the blade cylinder, and having an intermediate portion with a plurality of holes dispersed thereon;

a lid threadably engaging a neck portion of the perforated cylinder and retaining the perforated cylinder in a fixed position;

a generally cylindrical housing being coupled to the connector member and having the blade cylinder and the perforated cylinder therein, and the housing having the lid being snap fastened to a top end thereof; and a mixer motor being coupled to the connector member and the second end of the blade drive, the mixer supporting the housing having the blade cylinder and the perforated cylinder therein.

3. The electric spiral blade recycle food mixer as set forth in claim 2 wherein the blade cylinder being generally tower-shaped and having a cylindrical tip projecting from the top edge thereof.

4. The electric spiral blade recycle food mixer as set forth in claim 3 wherein the intermediate portion of the perforated cylinder having a bowl-like bottom portion interconnected thereto for allowing positioning of the perforated cylinder over the blade cylinder.

5. The electric spiral blade recycle food mixer as set forth in claim 3 wherein the tip of the blade cylinder being positioned within the lid, when the perforated cylinder and lid being coupled and the perforated cylinder is positioned over the blade cylinder.

6. The electric spiral blade recycle food mixer as set forth in claim 2 wherein the first end of the blade drive is slotted and projects upwardly from one side of the connector member to capture a catch pin of the keyhole of the blade cylinder, and the second end projecting downwardly from another side of the connector member.

7. The electric spiral blade recycle food mixer as set forth in claim 2 wherein each blade of the blade cylinder having a blunt edge and being wrapped around the blade cylinder along a symmetrical path, each blade having an upper end adjacent the top edge of the blade cylinder, each blade having a lower end adjacent the bottom edge of the blade cylinder.

8. The electric spiral blade recycle food mixer as set forth in claim 2 wherein the mixer motor having an outer wall and a rotating mechanism, the outer wall having a pair of L-shaped slots for lockingly engaging the fastener tabs of the connector member.

9. The electric spiral blade recycle food mixer as set forth in claim 8 wherein the rotating mechanism being capable of lockingly engaging the second end of the blade drive of the connector member, the mixer motor having a switch for turning the motor on and off, whereby the rotating mechanism being capable of causing the blade cylinder to rotate counter-clockwise within the perforated cylinder and the lid when the motor being turned on.

* * * * *